US005629585A

United States Patent [19]

Altmann et al.

[11] Patent Number: 5,629,585

[45] Date of Patent: May 13, 1997

[54] HIGH-PRESSURE DISCHARGE LAMP, PARTICULARLY LOW-RATED POWER DISCHARGE LAMP, WITH ENHANCED QUALITY OF LIGHT OUTPUT

[75] Inventors: Bernhard Altmann, Langerringen; Juergen Begemann, Munich; Juergen Maier, Berlin; Andreas Ponnier, Berlin; Ralf Seedorf, Berlin, all of Germany

[73] Assignee: Patent-Treuhand-Gesellschaft F. Elektrische Gluehlampen mbH, Munich, Germany

[21] Appl. No.: 510,185

[22] Filed: Aug. 2, 1995

[30] Foreign Application Priority Data

Sep. 21, 1994 [DE] Germany ..... 9415217 U

[51] Int. Cl.[6] ..... H01J 17/20; H01J 61/12; H01J 17/04; H01J 61/04

[52] U.S. Cl. ..... 313/570; 313/571; 313/574; 313/632

[58] Field of Search ..... 313/346 R, 355–570, 313/620, 621, 622, 630, 631, 633, 637, 639, 642

[56] References Cited

U.S. PATENT DOCUMENTS

| | | | |
|---|---|---|---|
| 3,054,014 | 9/1962 | Gemsa . | |
| 3,706,000 | 12/1972 | Retzer et al. | 313/570 |
| 4,724,352 | 2/1988 | Schuda et al. | 313/621 X |
| 4,906,895 | 3/1990 | Pabst . | |
| 4,988,918 | 1/1991 | Mori et al. | 313/620 X |
| 5,158,709 | 10/1992 | Setti . | |
| 5,284,614 | 2/1994 | Chen et al. . | |
| 5,422,539 | 6/1995 | Chodora | 313/631 |

*Primary Examiner*—Sandra L. O'Shea
*Assistant Examiner*—Mack Haynes
*Attorney, Agent, or Firm*—Frishauf, Holtz, Goodman, Langer & Chick, P.C.

[57] ABSTRACT

To improve the arc stability of high-pressure discharge lamps, particularly of power ratings of up to about only 250 W, the cathode (4) is formed as an elongated, essentially cylindrical base body (8) having a tapering, conical region (9) terminating in a tip (10). The base body (8), only, is covered with a carbide coating along its length, except for an end portion for electrical connection; the carbide coating starts at the junction or transition between the cylindrical base body portion and the conical end portion. This cathode construction is easier and cheaper to make than prior art cathodes, by coating an essentially cylindrical cathode and then etching or grinding and polishing the tapering end region (9). The electrode is preferably made essentially of tungsten, doped with thorium oxide present up to about 0.6%, optionally also potassium, aluminum and silicon in tiny amounts. The electrode spacing is between 0.4 to 0.8 mm, and when used as a mercury high-pressure discharge lamp, filled with 70 to 130 mg per cubic centimeter mercury; when used as a xenon lamp, the xenon fill is preferably present at a cold fill pressure of between about 2 and 15 bar.

20 Claims, 6 Drawing Sheets

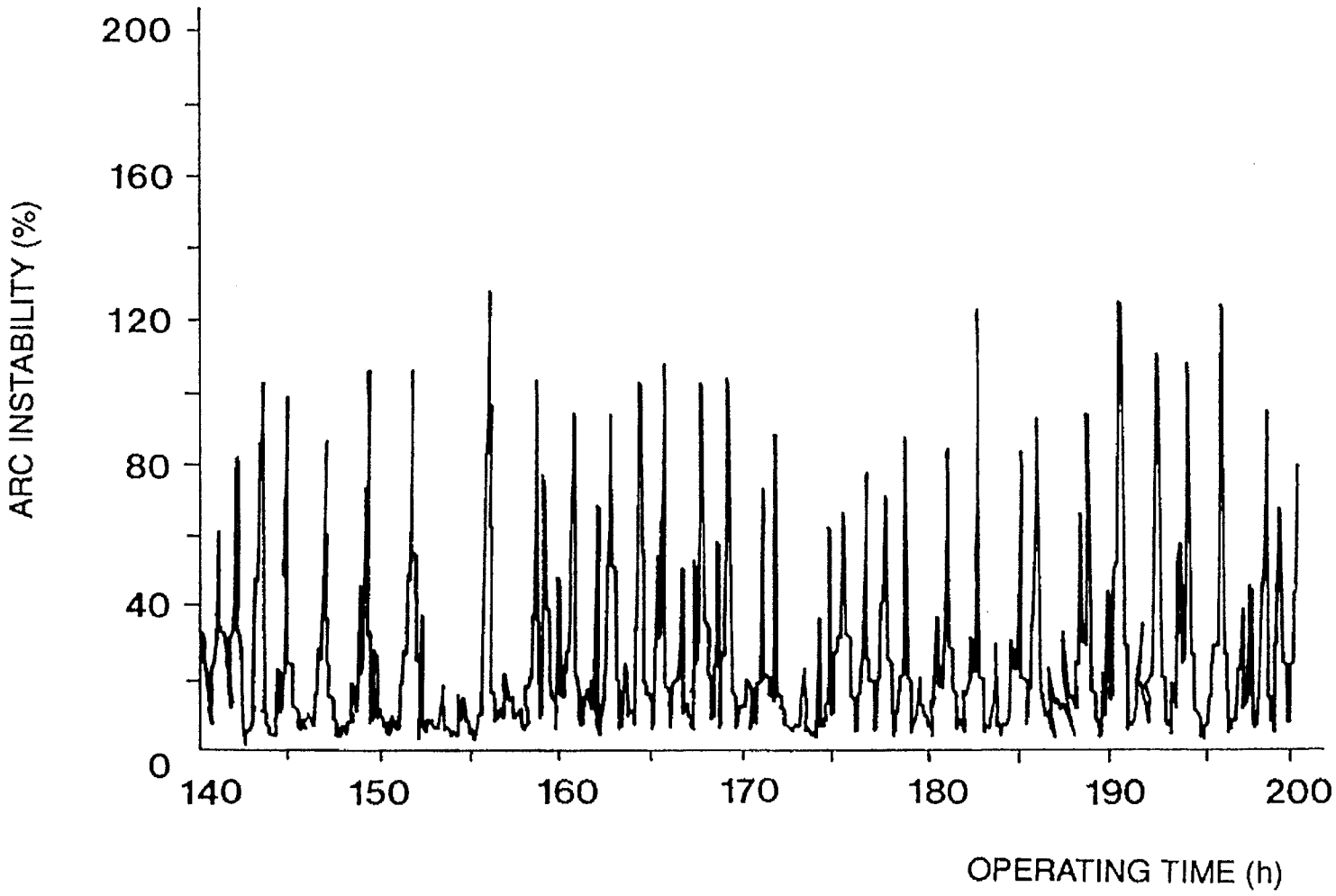
FIG. 3b— PRIOR ART

HIGH-PRESSURE DISCHARGE LAMP, PARTICULARLY LOW-RATED POWER DISCHARGE LAMP, WITH ENHANCED QUALITY OF LIGHT OUTPUT

Reference to related patents, the disclosures of which are hereby incorporated by reference:
U.S. Pat. No. 3,054,014, Gemsa
U.S. Pat. No. 4,906,895, Pabst et al.
U.S. Pat. No. 5,158,709, Setti
U.S. Pat. No. 5,284,614, Chen et al.

FIELD OF THE INVENTION

The present invention relates to high-pressure discharge lamps and particularly to such lamps suitable for power ratings of up to about 250 W. Such discharge lamps, which contain mercury, are used, for example, in fluorescence microscopy, but the lamps are also suitable as xenon high-pressure lamps of similar power ratings. The invention is also applicable to lamps of higher power ratings, although it is particularly suitable for use with lamps of up to about 250 W.

BACKGROUND

U.S. Pat. No. 4,906,895, Pabst et al., assigned to the assignee of the present application, discloses a high-pressure discharge lamp which has means to quiet the arc. According to this disclosure, the cathode, at least in the region of a tapered tip, is covered with a carbide layer. The thickness of the carbide layer continuously decreases towards the tip or leaves the tip region, approximately one-third of the length of the tapered tip, entirely free of carbide.

It has been found in operation and use that the stability of the arc can be improved, this is particularly important when lamps of this type are used in photometric applications. The manufacture of arc lamps with such tips is comparatively time-consuming and hence expensive.

THE INVENTION

It is an object to improve high-pressure discharge lamps in which the stability of the arc is further improved while, simultaneously, the maintenance of the density of light output throughout the lifetime of the lamp is enhanced and manufacturing costs reduces.

Briefly, the lamp has the conventional elements of a discharge vessel, a cathode and an anode axially located therein. The vessel is filled with an ionizable fill. The cathode is formed as a cylindrical base body which merges with a tapering end portion terminating in a tip end.

In accordance with a feature of the invention, the entire tapering portion between the tip end and the base body of the cathode is left free from carbide; the base body only is covered at least in part with carbide.

It has been found, surprisingly, that the stability of the arc can be maintained even though the tapering region does not have a carbide coating, when properly operated and, even, can be improved under certain circumstances. This operation is obtained when the tapered portion of the electrode is completely free of carbon, whereas a major portion of the cylindrical base body of the electrode, starting at the junction with the tapered portion, is covered with a coating of a carbide. Such electrodes can be easily made, and most simply by carburizing a cylindrical rod, as described, for example, in the aforementioned Pabst et al. U.S. Pat. No. 4,906,895; thereafter, the tapering tip is formed either by etching, grinding and/or polishing.

The arc is stable; during the overall lifetime of the lamp instabilities of the arc can be held below 10%.

The carburization cooperates particularly advantageously with special materials and structures of the cathode. When using thin cathodes of at the most about 5 mm diameter, a preferred electrode material has, besides tungsten, at the most 0.6% $ThO_2$. Preferably, the electrode is even smaller, and values below 2 mm diameter, most suitably under 1 mm, are especially preferred. The preferred range of $ThO_2$ is between about 0.2% to 0.45%. An additional doping with about 50 to 100 ppm potassium, up to about 20 ppm aluminum and up to about 10 ppm silicon, is particularly preferred. When making the electrode, care is taken to obtain specifically a long crystal lattice structure as well as fine dispersion of the thorium oxide.

Unless otherwise specified in the description and claims of this specification, all percentages are by weight.

It is now possible to use very little thorium oxide in the cathodes. Previously, about 3% were used. A wet chemical process, as described for example in the referenced Patent U.S. Pat. No. 5,284,614, Chen et al., permits this reduction. Thorium oxide is added already to the tungsten powder. Doping favors the formation of the desired long crystal lattice. The structure is similar to that described in the referenced U.S. Pat. No. 3,054,014, Gemsa, assigned to the assignee of the present application. It has been found particularly desirable to modify the customary deformation operation which was rolling, swaging and drawing, see, for example, the referenced U.S. Pat. No. 5,158,709, Setti, assigned to assignee of the present application, and references cited therein. Preferably, the customary swaging process is limited or not used at all, and rather a drawing process is used in an enhanced matter, to particularly form the long crystal lattice, stabilize the lattice and form it in the desired shape. The electrode diameter used is preferably matched to the degree of the limitation, or omission, even, of swaging. If the electrode diameters are very small, it is possible at times to entirely eliminate swaging also know as hammering.

After the rod is carburized, a region of decreased or tapering shape is formed by etching the tip to a cone, or to a truncated cone or frustum; alternatively, grinding and subsequent polishing can also be used.

Preferably, the base body forming an electrode shank is covered over at least 30%, and preferably more than 50% of its overall length by carbide, starting from the region in which the taper of the tip starts. The truncated cone or frustum has, preferably, a maximum length of 5 mm. The optimum height or length thereof depends on the cone opening angle and the cathode diameter. In larger diameters, for example about 4 mm, a larger opening angle of the cone is preferred, for example an angle of about 60°. This results in a height of the truncated cone or frustum, or cone tip, if used, of about 4 mm.

Another region on the cathode end remote from the discharge end is preferably free, or left free of carbide to provide a good electrical contact. The length of the tapering region is, preferably, larger or equal to the diameter of the cathode.

The decrease in light density of emitted light in operation, due to burning-off of the electrodes can be substantially reduced by a suitable selection of the geometry of the electrodes. Use of the cathode carburized only along its shank end, but not at the tapering tip, simplifies the electron emission at the tip of the electrodes. Thus, the required current density can be reached already at lower operating temperatures, which, again, reduces burning-off of the electrodes. Previously, the lifetime of lamps was about 200 hours. The average electrode burn-off increased the electrode spacing by about 100%, from, for example, typically 0.6 to 1.3 mm. The electrodes in accordance with the present invention have a burn-off rate which increases the electrode spacing during the lifetime of the lamp only between about 30 to 50% of its original spacing. A further consequence is that the increase in arc voltage during the lifetime of the lamp is also substantially reduced and can be limited to about 50% of the previously customary values.

The improved operating conditions lead to a substantial increase in the lifetime of the lamp, an increase of about 50%, that is, from about 200 to 300 hours.

The invention can be used with high-pressure discharge lamps of the mercury high-pressure type, in which, for example, about 10–80 mg/cm$^3$ of mercury are used, with an electrode spacing from about 0.5 to 4 mm and an arc voltage of up to about 50 V.

The invention is particularly suitable for use with mercury high-pressure discharge lamps having low-power ratings, that is, in the range of about 50 to 200 W. The lamp in accordance with the present invention provides the basis to optimize the radiation intensity such that the wave-length regions appropriate for specific uses will be obtained. This is usually done by increasing the quantity of mercury. Increasing the mercury, however, previously was found not to be possible in low-power lamps since such lamps had a tendency for premature failure. With the improved electrodes in accordance with the present invention, higher dosing of mercury between about 70 and 130 mg/cm$^3$ is possible, without decreasing the lifetime of the lamp. It is possible to obtain short wave-length radiation intensity, particularly in the region between 400 and 500 nm, that is, obtain increases from 20 to 40% without reduction in other, also used wave-length regions.

The lamp, and having the electrodes as described, permits for the first time to use mercury high-pressure discharge lamps in combination with reflectors as a very small constructional unit, for example for use in endoscopy.

The lamps are also used in the form of xenon high-pressure discharge lamps having power ratings of, for example, up to about 250 W.

DRAWINGS

Figure 1:
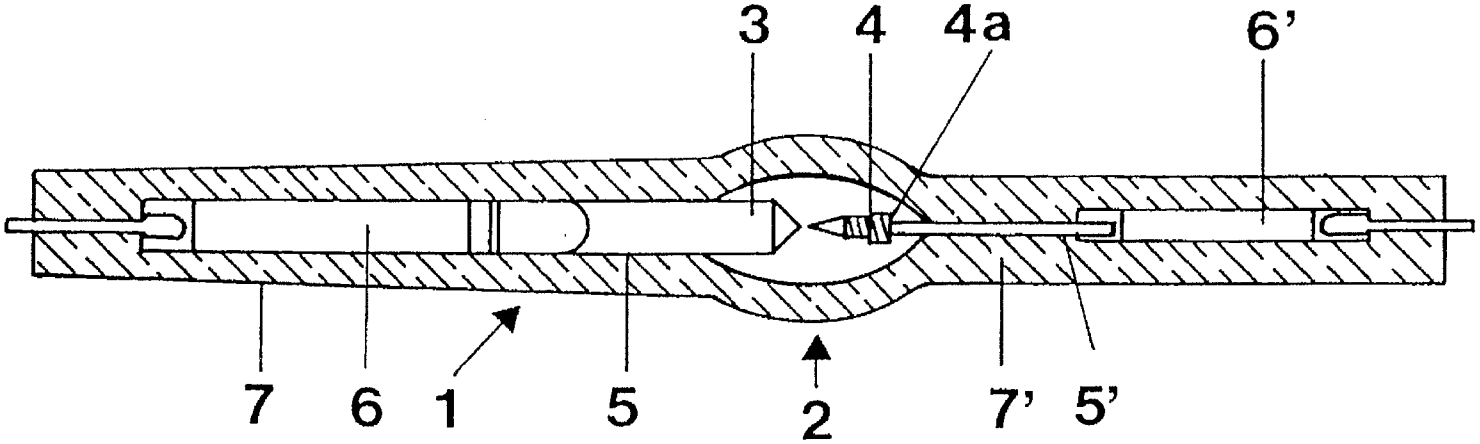
FIG. 1 is a highly schematic part cross-sectional view of a mercury high-pressure discharge lamp in accordance with the present invention.
Figure 3A:
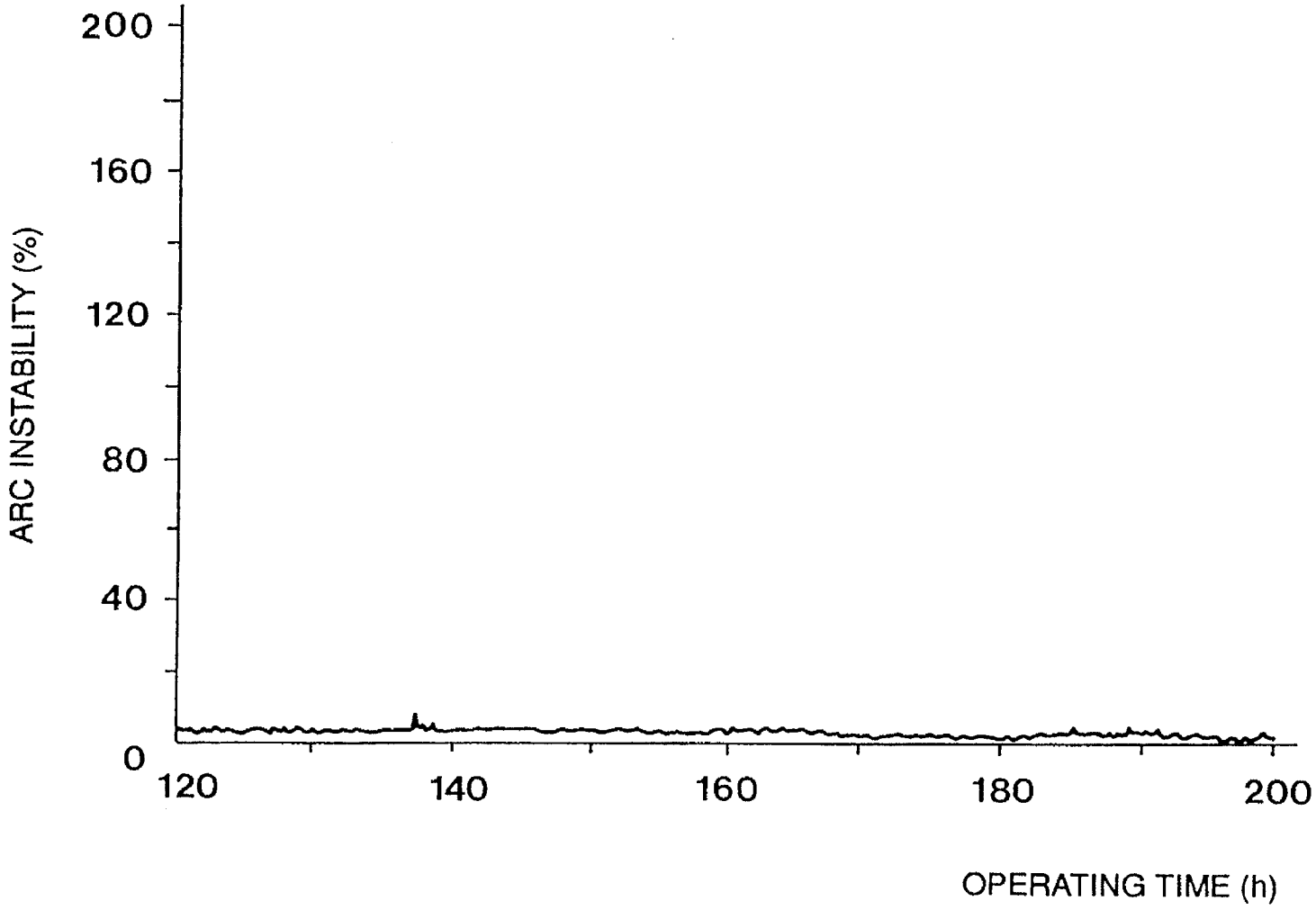
Figure 4:
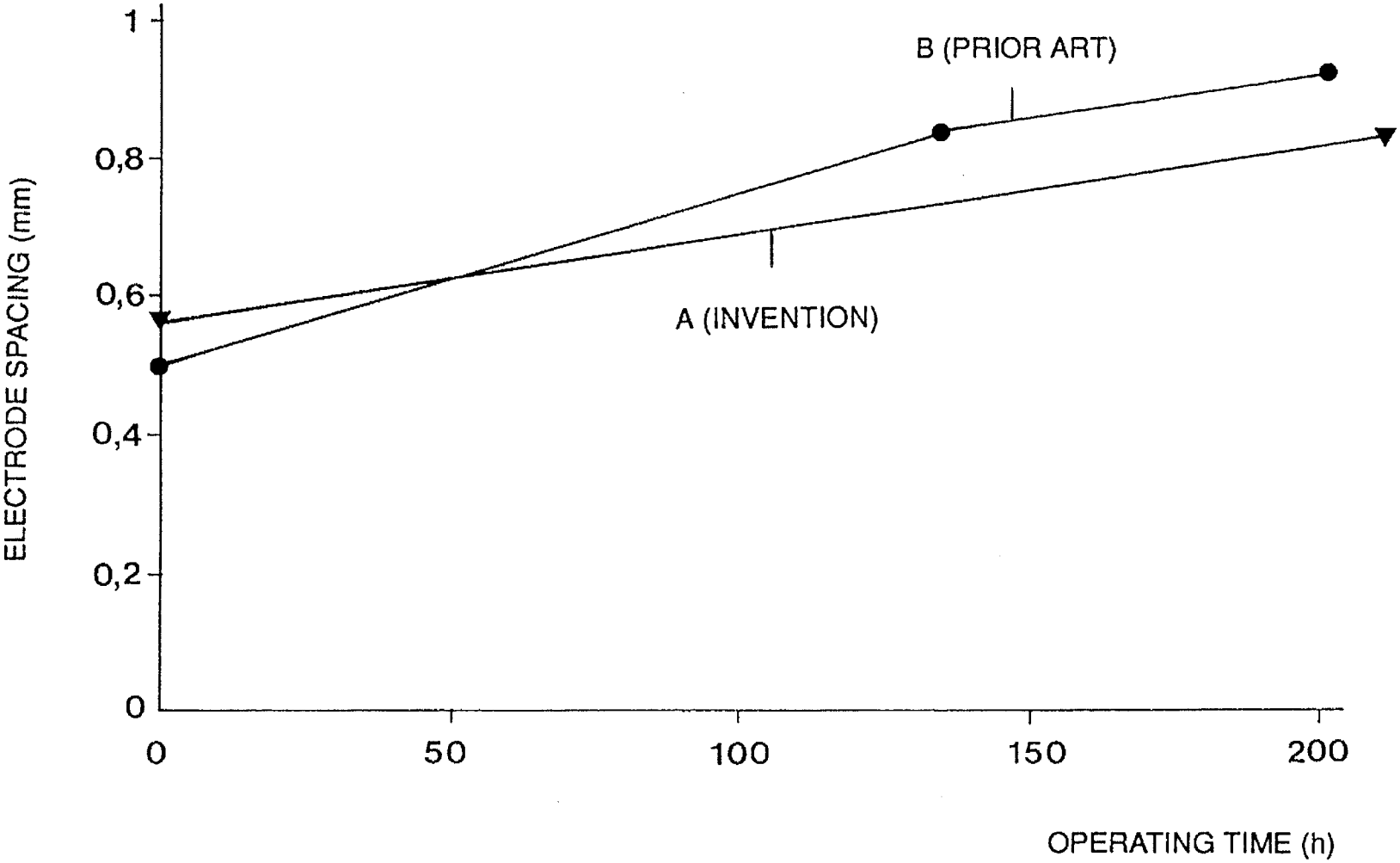
Figure 5:
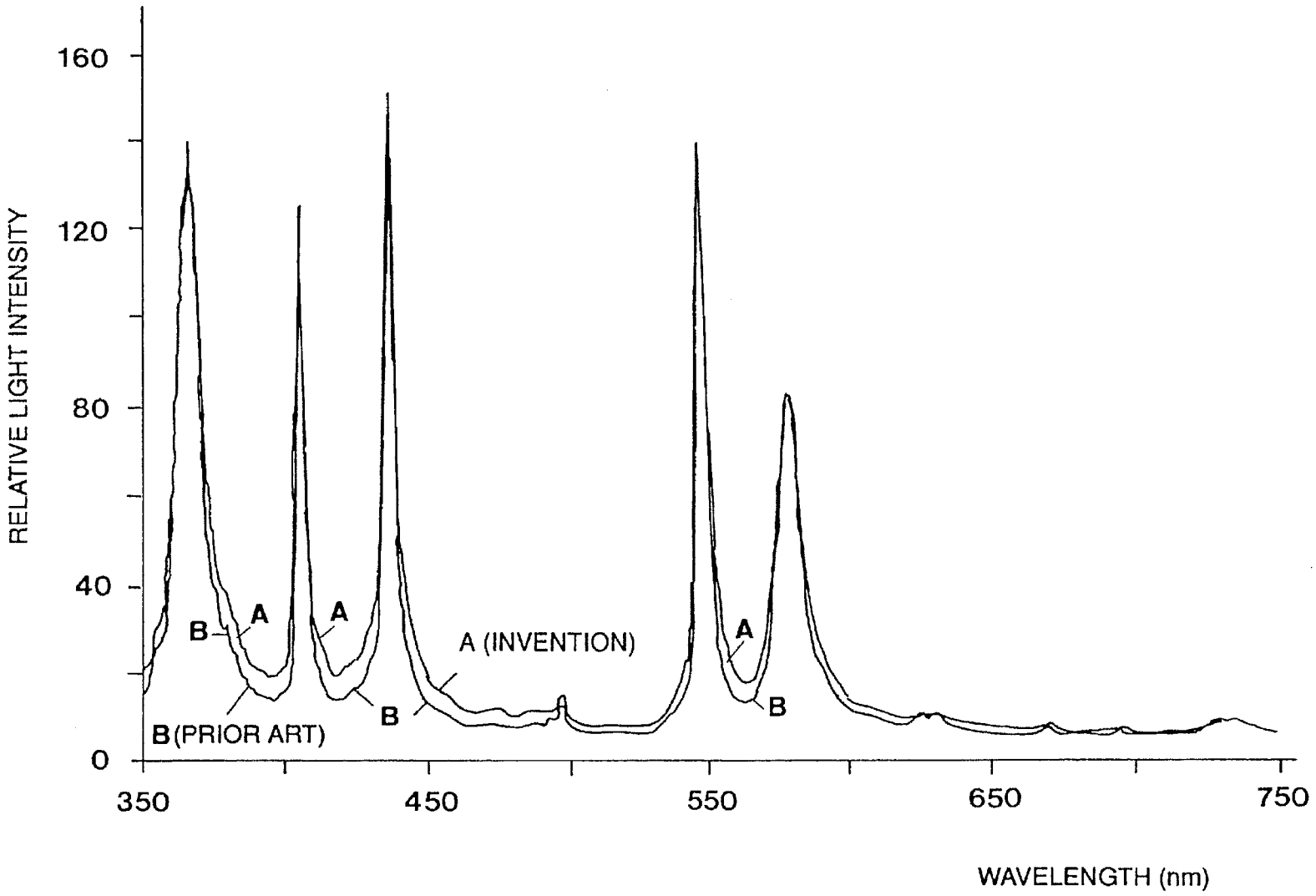
Figure 7:
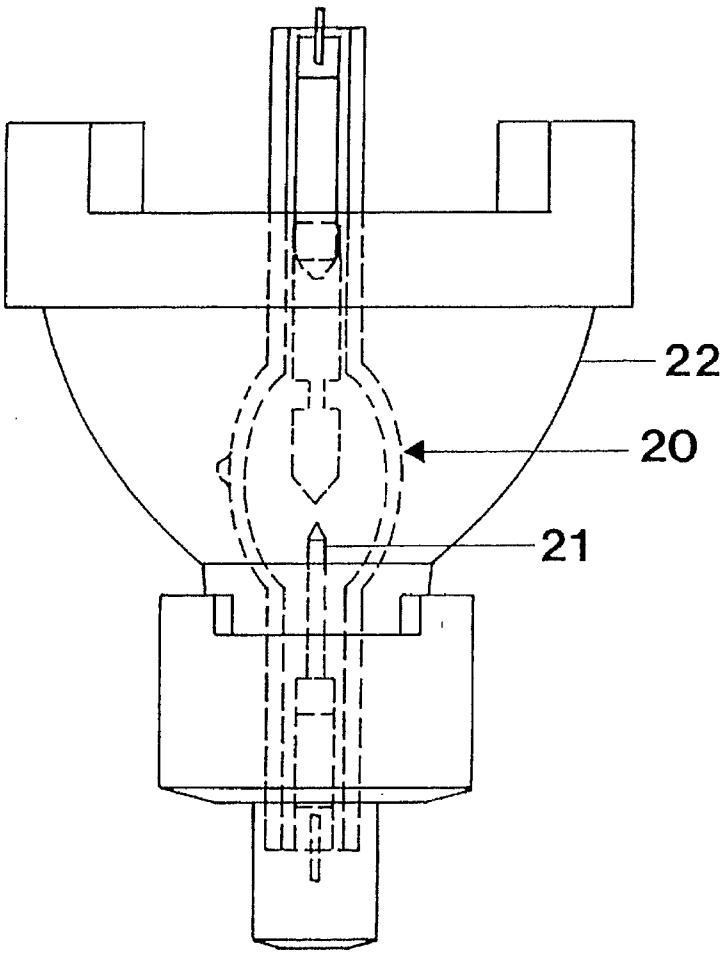
Figure 6:
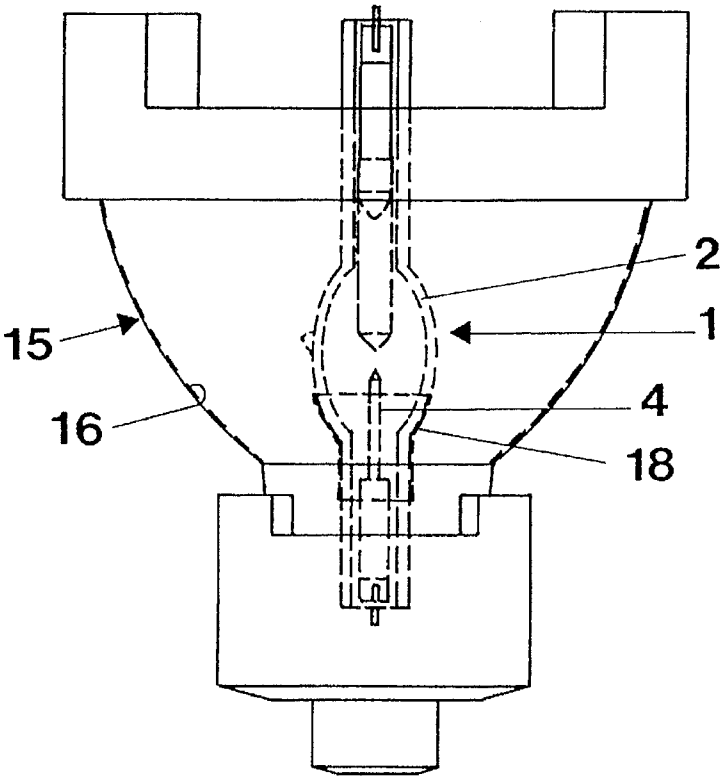

FIG. 3*a* is a diagram relating arc instability to operating time for a lamp in accordance with the present invention;

FIG. 3*b* is a graph similar to FIG. 3*a* and illustrating the arc instability versus lifetime relationship for a prior art lamp;

FIG. 4 is a graph relating the electrode spacing (ordinate) of a lamp of FIG. 1 as a function of operating time;

FIG. 5 is a graph comparing the spectrum of lamps of the present invention with lamps of the prior art;

FIG. 6 is a schematic view of a lamp in accordance with the present invention within a reflector; and FIG. 7 illustrates the lamp in accordance with the present invention in a reflector, in which the lamp unit or light-emitting unit is a xenon high-pressure discharge lamp.

DETAILED DESCRIPTION

Referring first to FIG. 1, which illustrates a d-c 100 W mercury high-pressure discharge lamp. The lamp 1 is particularly suitable for fluorescence microscopy, and fluorescent endoscopy; it is also suitable for other applications, such as light guides, optical cables, Schlieren photography, and reproduction of holograms.

The lamp 1 has an elliptical discharge vessel 2 of quartz glass, with a volume of about 0.2 cm$^3$, which is filled with 18 mg mercury. The overall length of the vessel 2 is 73 mm. The discharge vessel 2 retains therein an anode 3 and a cathode 4. The electrode distance between anode and cathode is 0.6 mm. The anode and cathode are axially in alignment within the lamp. Each electrode has a cylindrical shaft 5, 5', respectively.

Electrical current is supplied to the electrodes over molybdenum foils 6,6' which are electrically connected to contact pins with metallic bases, not shown, and of any suitable standard construction. The molybdenum foils 6,6' are vacuum tightly melt-sealed in the two ends 7,7' of the discharge vessel 2. It is not necessary to use a molybdenum melt-seal connection; other technologies, such as rod melt sealing, or cup-shaped or flare mounts, can be used.

The anode 3 is formed as a massive cylindrical block made of swaged tungsten. It has a broad, outwardly slightly tapering end surface.

Figure 2:
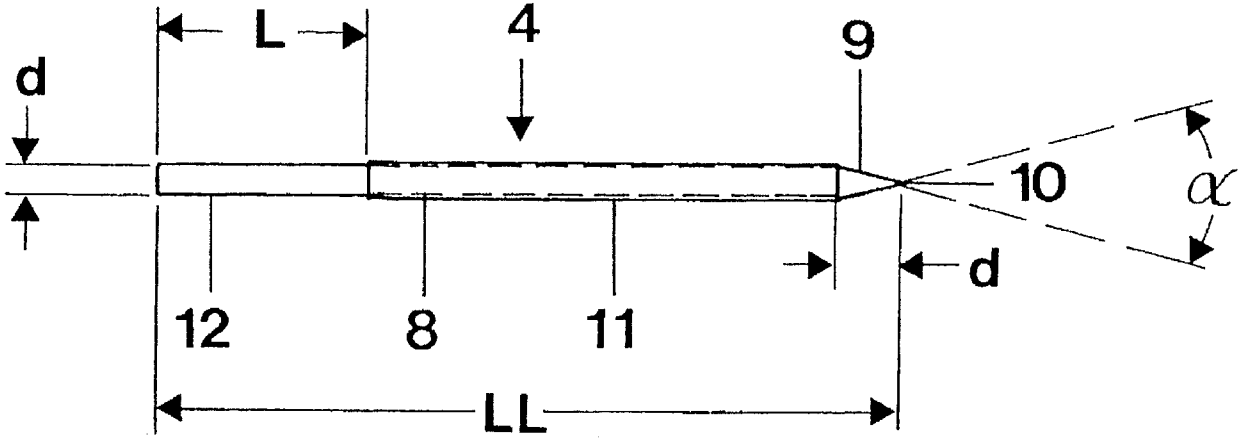
FIG. 2 is a schematic side view of the cathode for the lamp of FIG. 1.

The cathode 4 is substantially smaller than the anode. A wrap winding 4*a*is fitted on the cathode 4. The cathode itself is seen in FIG. 2 to a substantially enlarged scale, although the illustration is pictorial and not to specific scale. To ensure high stability of the arc between the anode and the cathode, the cylindrical base body 8 of the cathode 4 is formed with a conical tapering end portion 9, the tip 10 of which is blunted. The diameter d of the electrode shaft or shank base body 8 is, in the example, 0.6 mm, and it has an overall length LL of 16 mm. The frusto-conical tip 10 which forms the attachment point for the arc has a diameter of 0.1 mm. The cone forms an opening angle $\alpha$ of about 15° and has an overall length 1 of about 1.7 mm.

In accordance with a feature of the invention, the cone 9 is devoid of, or free from carbide, whereas the cylindrical base body 8 is coated over its length by a layer 11 of tungsten carbide, except for a short end region 12, having a length L of 4.5 mm, to ensure good electrical connection.

It is not necessary that the cylindrical base body 8 is entirely covered with carbide; it is also possible, for example, to carburize only about half of its entire length, starting from the transition of the cylindrical base body to the tapering tip 9.

The cathode 4 is made of tungsten with a small quantity of further additives, preferably, for example, about 0.4% thorium dioxide, 75 ppm potassium, 10 ppm aluminum and 5 ppm silicon, the additives forming doping substances.

The carbide layer 11 on the cathode 4 has a thickness of 5 micrometers. Generally, a thickness of the layer 11 between 1 and 15 μm can be used; a preferred range is between 3 and 8 μm. The tapering region 9 can be formed as a single cone or truncated cone; it can also be generated in form of a plurality of cone regions, that is, truncated cones with different opening angles.

FIGS. 3*a* and 3*b* illustrate, by comparison, the difference between arc instability of a lamp in accordance with the present invention, FIG. 3*a*, and a prior art lamp, FIG. 3*b*. The lamp in accordance with the invention, FIG. 3*a*, as clearly seen, has an arc instability of only a few percent within an operating time of 200 hours; in contrast, the arc instability of a prior art lamp (FIG. 3*b*) is worse by an order of magnitude and reaches values of up to over 100%.

FIG. 4 is a graph relating electrode spacing (ordinate) and operating time (abscissa). Curve A shows the relationship of the lamp of the present invention. It clearly shows that from a starting value of just under 0.6 mm, the electrode spacing has increased only to about 0.85 mm, that is, by about 40%, after 200 hours of operation. In contrast, a prior art lamp having an original electrode spacing of about 0.5 mm had an increase to almost twice the starting spacing, namely 0.95 mm, after 200 hours. The average arc voltage is directly proportional to the electrode spacing. The increase in operating voltage of the lamp in accordance with the present invention was only about 5 V, changing from 23 V to 28 V, whereas, in the prior art lamp, the increase in voltage was more than 10 V. A smaller increase in operating voltage is particularly important because high operating voltages, especially of over 30 V, may overload ballasts and accessory current supply circuits to which the lamp must be connected.

FIG. 5 shows a comparison between the lamp spectrum of lamps in accordance with the present invention (graph A) and the prior art (graph B). The higher light intensity is particularly apparent in the short wave length spectral region and can be clearly seen up to about 600 nm. For example, the intensity of the lamp in accordance with the present invention, graph A, in the spectral band of 355 to 375 nm is 10% higher than that of the prior art lamp (graph B); in the band of between 450 to 500 nm, the increase is 38% and in the band from between 535 to 555 nm, the increase of light intensity of the lamp in accordance with the present invention over that of the prior art is 17%.

The invention is not restricted to lamps as shown in FIG. 1. FIG. 6 illustrates a mercury high-pressure discharge lamp 1 combined with a reflector 15 for use in endoscopy. The reflector lamp has an overall height of only 83 mm, and a maximum diameter of 67 mm. Lamp 1 is seated axially in an elliptical reflector 15, which is coated with a dichroic coating 16. This reflector lamp emits radiation primarily in the wave-length range between 320 to 390 nm. It is particularly suitable for curing of varnishes and lacquers. The cathode 4 of the lamp is close to the apex of the reflector 15. A heat retention or heat damming layer 18 covers approximately the lower third of the discharge vessel 2.

FIG. 7 illustrates a xenon high-pressure discharge lamp having a power rating of 180 W. It has a cathode 21 with a diameter of 1.5 mm, which, at its tip end, has a truncated cone with a height of 3.5 mm, having a cone opening angle of 26°. The lamp 20 is located, axially, in a reflector 22, similar to the lamp described in FIG. 6.

Current supplies to the lamps, through the bases, shown only schematically, and to the remote end can be constructed in accordance with any well-known arrangement, supplying electrical energy to double-ended lamps from single bases.

The wrap winding 4*a* in FIG. 1 around the cathode is placed over the carbide coating 11, and includes, preferably, a few tightly wrapped turns of tungsten wire of substantially smaller diameter than the cathode 4, spaced from the junction with the tip region 9 in order to form an enlarged heat dissipation surface for the cathode. A suitable number of turns for winding 4*a* is 5 to 6 turns of wire having a diameter of 0.4 mm for a cathode of 0.6 mm diameter.

Various changes and modifications may be made in any features described herein may be used with any of the others, within the scope of the inventive concept.

We claim:

1. High-pressure discharge lamp having a discharge vessel (2) defining an axis;

an ionizable fill within the discharge vessel;

an anode (3) located axially within the discharge vessel;

a cathode (4) located axially within the discharge vessel and spaced internally from the anode (3) by an arc gap, said cathode (4) having an essentially cylindrical base body portion (8) and a tapering end portion (9) terminating, at the arc gap, in a tip end (10), and comprising, in accordance with the invention a carbide coating (11) which, at least in part, covers the base body portion (8) only while leaving the entire tapered end portion (9) between the tip end (10) and the base body portion (8) of the cathode (4) devoid of carbide coating.

2. The lamp of claim 1, wherein the fill comprises mercury between about 70 to 130 milligram per cubic centimeter of volume of the discharge vessel.

3. The lamp of claim 2, wherein said electrode gap is between about 0.4 to 0.8 mm.

4. The lamp of claim 2, wherein the lamp, when energized, has an arc voltage of between about 20 to 29 V.

5. The lamp of claim 2, wherein the lamp, when energized, has an arc voltage in the order of about 23 V.

6. The lamp of claim 1, further including a reflector (15, 22) forming, together with the discharge vessel, a single unit.

7. The lamp of claim 1, wherein the lamp has a rated power of up to about 250 W.

8. The lamp of claim 1, wherein the carbide layer (11) has a thickness of between about 1 and 15 μm.

9. The lamp of claim 1, wherein the carbide layer (11) of carbide has a thickness of between about 3 and 8 μm.

10. The lamp of claim 1, wherein the length (1) of the tapering end portion (9) is up to about 5 mm.

11. The lamp of claim 1, wherein the cathode comprises essentially tungsten and up to about 0.6%, by weight, of $ThO_2$.

12. The lamp of claim 11, wherein the/cathode has doping additives of at least one of potassium, aluminum, silicon.

13. The lamp of claim 11, wherein the tungsten of the cathode (4) has an elongated crystal structure.

14. The lamp of claim 1, wherein said fill comprises xenon having a cold fill pressure of between about 2 and 15 bar.

15. The lamp of claim 1, wherein the carbide layer (11) has a thickness of between about 1 and 15 μm;

and wherein the length (1) of the tapering end portion (9) is equal to or larger than the diameter of the base body portion (8) of the cathode (4).

16. The lamp of claim 15, wherein said tapering end portion (9) is conical, or frusto-conical, having a complete opening cone angle of between about 10° and 30°.

17. The lamp of claim 1, wherein the base body (8) is covered by the carbide coating (11) over at least 30% of its length, said coating starting from the junction of the tapering end portion (9) with the base body (8).

18. The lamp of claim 1, wherein the base body (8) is covered by the carbide coating (11) over at least 50% of its length, said coating starting from a junction of the tapering end portion (9) with the base body (8).

19. The lamp of claim 17, wherein the carbide layer (11) has a thickness of between about 1 and 15 μm;

wherein the length (1) of the tapering end portion (9) is up to about 5 mm;

wherein said tapering end portion (9) is conical, or frusto-conical, and has a complete opening cone angle of between about 10° and 30°; and wherein the fill comprises mercury between about 70 to 130 milligram per cubic centimeter of volume of the discharge vessel.

20. The lamp of claim 17, wherein the carbide layer (11) has a thickness of between about 1 and 15 μm;

wherein the length (1) of the tapering end portion (9) is up to about 5 mm;

wherein said tapering end portion (9) is conical, or frusto-conical, and has a complete opening cone angle of between about 10° and 30°; and wherein said fill comprises xenon having a cold fill pressure of between about 2 and 15 bar.

* * * * *